United States Patent [19]

Saito

[11] Patent Number: 4,739,870

[45] Date of Patent: Apr. 26, 1988

[54] MOVING STAIRCASE WITH A CURVED CONVEYOR PASSAGE

[75] Inventor: Ryoichi Saito, Ichinomiya, Japan

[73] Assignee: Mitsubishi Denki Kabushiki Kaisha, Japan

[21] Appl. No.: 880,944

[22] Filed: Jun. 25, 1986

Related U.S. Application Data

[63] Continuation of Ser. No. 649,302, Sep. 11, 1984, abandoned.

[30] Foreign Application Priority Data

| | | | |
|---|---|---|---|
| Sep. 19, 1983 | [JP] | Japan | 58-172511 |
| Sep. 27, 1983 | [JP] | Japan | 58-178489 |
| Sep. 27, 1983 | [JP] | Japan | 58-149185[U] |
| Sep. 27, 1983 | [JP] | Japan | 58-149186[U] |

[51] Int. Cl.[4] ..... B66B 21/02

[52] U.S. Cl. ..... 198/328; 198/329; 198/778

[58] Field of Search ..... 198/326–333, 198/778, 845

[56] References Cited

U.S. PATENT DOCUMENTS

| | | | |
|---|---|---|---|
| 617,779 | 1/1899 | Seeberger . | |
| 710,934 | 10/1902 | Aston | 198/845 |
| 727,720 | 5/1903 | Venn . | |
| 782,009 | 2/1905 | Dodge | 198/778 |
| 889,080 | 5/1908 | Wheeler . | |
| 999,885 | 8/1911 | Seeberger . | |
| 1,804,701 | 5/1931 | Mojonnier . | |
| 1,868,780 | 7/1932 | Valtier | 198/329 |
| 1,956,153 | 4/1934 | Lindquist et al. | 198/326 |
| 2,023,067 | 12/1935 | Dunlop | 198/329 |
| 2,135,188 | 11/1938 | Lindquist . | |
| 2,641,351 | 6/1953 | Riley | 198/328 |
| 2,663,400 | 12/1953 | Margles et al. | 198/332 |
| 2,695,094 | 11/1954 | Riley . | |
| 2,823,785 | 2/1958 | Hefti . | |
| 2,940,578 | 6/1960 | Clemetsen et al. | 198/329 |
| 3,365,051 | 1/1968 | Mullis et al. . | |
| 3,419,127 | 12/1968 | Yost | 198/329 |
| 3,520,398 | 7/1970 | Thomson . | |
| 3,834,513 | 9/1974 | Miura et al. . | |
| 3,878,931 | 4/1975 | Luna . | |
| 4,064,986 | 12/1977 | Bertovich . | |
| 4,235,326 | 11/1980 | Nakao et al. | 198/326 |
| 4,440,294 | 4/1984 | Langen | 198/845 |

FOREIGN PATENT DOCUMENTS

| | | | |
|---|---|---|---|
| 558325 | 8/1932 | Fed. Rep. of Germany | 198/326 |
| 628965 | 4/1936 | Fed. Rep. of Germany | 198/328 |
| 2262203 | 7/1973 | Fed. Rep. of Germany . | |
| 2809861 | 9/1978 | Fed. Rep. of Germany . | |
| 319726 | 3/1902 | France . | |
| 852012 | 1/1940 | France | 198/328 |
| 2349528 | 11/1977 | France . | |
| 48-25559 | 7/1973 | Japan . | |
| 397435 | 1/1974 | U.S.S.R. | 198/778 |

*Primary Examiner*—Robert J. Spar
*Assistant Examiner*—Lyle K. Kimms
*Attorney, Agent, or Firm*—Leydig, Voit & Mayer

[57] ABSTRACT

A moving staircase having an arcuate conveyor passage in plan view is disclosed in which the tread boards articulated in an endless fashion along the arcuate conveyor passage are each rotatably provided with a tread board axle in the widthwise direction, the tread board axle rotatably carrying outer and inner drive rollers near its outer and inner ends, respectively, and these outer and inner drive rollers are adapted to be supported on and guided by the outer and inner rails, respectively, secured to the main frame. The outer and/or inner drive rollers are prevented from derailing from the outer and/or inner drive rails by presser rails secured to the main frame, and side rollers mounted on the tread board axles to resist the radially inward force applied to the tread boards in operation are adapted to abut against the side surfaces of the outer and/or inner drive rails and the presser rails. The side rollers are also prevented from derailing from the corresponding rail surfaces due to the prevention of the derailing of the drive rollers by the presser rails.

7 Claims, 13 Drawing Sheets

MOVING STAIRCASE WITH A CURVED CONVEYOR PASSAGE

This application is a continuation, of now abandoned application Ser. No. 649,302, filed Sept. 11, 1984, abandoned.

BACKGROUND OF THE INVENTION

The present invention relates to a moving staircase and more particularly to an improvement in the construction of a guide for tread boards in a curved moving staircase which has a curved conveying path in plan view.

In a conventional moving staircase of this kind, as shown in FIGS. 1 to 3 of the attached drawings, a main frame 1 of the moving staircase having a semicircular configuration in plan view is arranged substantially obliquely upwards. Supported in an endless fashion by the main frame 1 is a conveyor passage 2 which includes an inclined upper load run 2*a* on the upper side of the main frame 1, horizontal deflection portions 2*b* at both ends of the main frame 1, and an inclined lower return run 2*c* on the lower side of the main frame 1. The conveyor passage 2 comprises a number of tread boards 3 articulated together, each having generally the shape of a sector in plan view and provided on its underside at the forward end thercof (relative to the direction of movement) with a rotatable horizontal tread board axle 3*a* extending in the widthwise direction. The axle 3*a* fixedly carries a bracket 7*a* at its outer end portion which rotatably supports a pair of outer drive rollers 3*b*, while the axle 3*a* rotatably supports an inner drive roller 3*c*, the outer and inner drive rollers 3*b* and 3*c* being supported on and guided by outer and inner drive rails 4*a* and 4*b*, respectively, which are disposed within the main frame 1 along the outer and inner peripheries of the conveyor passage 2 and secured to the main frame 1 at the outer and inner arcuate peripheries thereof, respectively, by any suitable means such as brackets. An outer and inner follower roller, similar to the follower rollers 20*a* and 20*b* shown in FIGS. 5 and 6 to be referred to later, but not visible in FIG. 3, are provided on the tread board 3 on its underside at the rear end thereof (relative to the direction of motion), and are adapted to be supported on and guided by outer and inner follower rails 5*a* and 5*b* secured to the main frame 1 along the outer and inner peripheries of the conveyor passage 2, respectively, by any suitable means such as brackets. The tread board axles 3*a* are connected together at their outer and inner ends by endless outer and inner tread board chains 6*a* and 6*b*, respectively. Further, each tread board axle 3*a* is provided at its outer end portion with a side roller 7 rotatably mounted on the bracket 7*a* with the side roller 7 disposed at right angles to the outer drive rollers 3*b*, the side roller 7 being adapted to be abutted against a guide rail 8 which is fixedly secured to the main frame 1 through a bracket along the outer periphery of the circular arc of the conveyor passage 2, the side roller 7 serving to carry a load directed to the center of the circular arc of the conveyor passage 2 in cooperation with the guide rail 8, the load being generated as the result of the moving of the tread boards 3. Reference numeral 9 denotes a driving means provided at the upper deflection portion 2*b* of the conveyor passage 2 and supported by the main frame 1, comprising a driving motor 9*b* and a pair of sprocket wheels 9*a* transversely spaced apart and adapted to be driven by the driving motor 9*b*, receiving thereon the endless tread board chains 6*a* and 6*b*, respectively, of the tread boards 3 at the upper deflection portion 2*b*. 10 denotes a tension wheel means provided at the lower deflection portion 2*b* of the conveyor passage 2. The tension wheel means 10 is provided with outer and inner sprocket wheels 10*a* and 10*b*, respectively, which are spaced apart in the widthwise direction, the sprocket wheels 10*a* and 10*b* being adapted to have reeved thereon the outside and inside tread board chains 6*a* and 6*b*, respectively. Accordingly, the diameter of the outer sprocket wheel 10*a* is larger than that of the inner sprocket wheel 10*b*.

The construction of the outer and inner drive rails 4*a* and 4*b* will be more precisely explained taking the inner drive rail 4*b* as an example. In the prior art apparatus of FIGS. 1–3, just as shown in FIG. 10 for the apparatus of this invention, the inner drive rail 4*b* belonging to the upper load run 2*a* of the conveyor passage 2 switches over at its lower end portion to a horizontal inner drive rail 4*b'* at the inner end of the lower deflection portion 2*b* of the conveyor passage 2, the drive rail 4*b'* terminating in an inclined portion 4*b''*, the free end of which is bent downward substantially towards the center of the lower deflection portion 2*b*.

Similarly, the drive rail 4*d* belonging to the lower return run 2*b* switches over at its lower end portion to a horizontal inner drive rail 4*d'* at the inner end of the lower deflection portion 2*b*, the drive rail 4*d* terminating in an inclined portion 4*d''*, the free end of which is bent upwards substantially towards the center of the lower deflection portion 2*b*. At this point it should be noticed that the other rails shown in FIG. 10 such as those designated by reference numerals 12*b* and 12*d* are not provided in the conventional staircase and will be described fully later on in connection with the present invention. This applies also to all of FIGS. 8 to 11.

Upon energizing the driving means 9, the sprocket wheels 9*a* are driven, and the tread boards 3 are driven through the outer and inner tread board chains 6*a* and 6*b* which are reeved on the sprocket wheels 9*a*. Therefore, the outer and inner drive rollers 3*b* and 3*c*, the follower rollers 20*a* and 20*b*, and the side rollers 7 of the tread boards 3 are guided along the upper load run 2*a* of the conveyor passage 2 by the drive rails 4*a* and 4*b*, the follower rails 5*a* and 5*b*, and the guide rail 8, respectively, and roll on them so that the tread boards 3 are circulated along the conveyor passage 2. In this case, the tread boards 3 are subjected to a component of force directed towards the center of the circular arc of the conveyor passage 2, the component being carried by the side rollers 7 and by the guide rail 8 guiding them.

However, in the conventional curved moving staircase as shown in FIG. 3, there are no pusher rails to prevent the drive rollers 3*b* and 3*c* from being raised up from the drive rails 4*a* and 4*b* at the inclined portions 2*a* and 2*c* of the conveyor passage 2 other than at certain sections where the drive rollers 3*b* and 3*c* are subjected to forces urging them upwards.

However, with the construction shown in FIGS. 1 to 3, although a force to urge the drive rollers 3*b* and 3*c* upwards is not usually applied to them during their normal movement, should the drive rollers 3*b* and 3*c* be raised up for some unavoidable reasons, the side rollers 7 can come off the guide rail 8 so that the tread boards 3 may be displaced towards the center of the circular arc of the conveyor passage 2 due to the force applied thereto in that direction or in the direction of the tread board axle 3*a*. Further, the drive rollers 3*b* and 3*c* may also be raised up from the drive rails 4a and 4b, such as during their travel along the upper load run 2a, endangering the passagers.

Moreover, since in the above-described conventional moving staircase, the guide rail 8 for the side rollers 7 is independent of the drive rails 4a and 4b, the number of parts becomes large, necessiating considerable time for manufacture, assembly, and adjustment, of a moving staircase of this kind.

On the other hand, at the lower deflection portion 2b, for instance, as shown in FIG. 10, the inner drive rails 4b and 4d are connected at their lower ends to the horizontal inner drive rails 4b' and 4d', respectively. These rails cause the endless inner tread board chain 6b to smoothly mesh with the sprocket wheel 10b having a smaller diameter than the sprocket wheel 10a, the larger sprocket wheel 10a being adapted to mesh with the outside tread board chain 6a.

As can be easily understood, in the conventional moving staircase of this kind, the rails 4b, 4b', 4b'', 4d, 4d', 4d'', etc. are all fixedly secured to the main frame 1, and the tension wheel means 10 are adapted to be shifted substantially horizontally outwards relative to the conveyor passage 2 as the tread board chains 6a and 6b elongate due to wear, etc. so that any slack in the chains can be compensated for. In this case, in a usual straight moving staircase such as is shown in FIG. 11, the outer drive rail 4b or the rails which correspond to the rails 4b, 4d, etc. of FIG. 10 have no inclined rails such as 4b'', 4d'' at their lower deflection portion 2b. Therefore, even if the inner sprocket wheel 10b is shifted by an amount W as shown in FIG. 11, it does not cause any problems in the operation of the escalator.

Contrarily, in the curved moving staircase shown in FIG. 10, since the inner drive rails 4b and 4d are provided with the horizontal rail portions 4b', 4d' as well as the inclined rail portions 4b'' and 4d'', if the inner sprocket wheel 10b is shifted outwards by the same distance W as in FIG. 12, it causes several problems. That is, the inner drive rollers 3c are caused to deviate from the rail portions due to the gradual increase in the distance between the tread board chain 6b and the inclined inner rail portions 4b'' and 4d'' as will be readily seen from FIG. 12, with the result that the inner drive rollers 3c are made unstable or can not ride smoothly on the rails, causing oscillations, noise, etc. or even damaging the machine parts.

SUMMARY OF THE INVENTION

It is a principal object of the present invention to provide a moving staircase with a curved conveyor passage in which the outer and/or inner drive rollers are prevented from being derailed from the outer and/or inner drive rails during the operation of the moving staircase.

It is another object of the present invention to provide a moving staircase with a curved conveyor passage in which the inner sprocket wheel of the tension wheel means provided at the lower deflection portion of the conveyor passage can be horizontally shifted without the fear of derailing the inner drive rollers from the inner drive rail at the time of the adjustment of the tension of the tread board chains.

It is a further object of the present invention to provide a moving staircase with a curved conveyor passage in which the strength and the rigidity of the support members for the side drive rails to guide the side drive rollers are made sufficiently large so that the dimensions of the side drive rails need not be increased.

In accordance with the present invention a moving staircase with a curved conveyor passage is provided which comprises a main frame, a number of tread boards articulated in an endless fashion and shiftably supported by the main frame so as to circulate along a conveyor passage which is formed of an upper load run, a lower return run, and a horizontal upper and lower deflection portions connecting the upper load and lower return runs together at their upper and lower end portions, respectively, a number of tread board axles each swingably carrying the tread boards and extending transversely with respect to the circulation direction of the tread boards, outer and inner drive rollers rotatably mounted on each of the tread board axles near the outer and inner end portions thereof, respectively, upper and lower outer and inner drive rails fixedly secured to the main frame and adapted to carry thereon the outer and inner drive rollers in the upper load and lower return runs, respectively, outer and inner follower rollers respectively rotatably mounted on each of the tread boards at both of its sides, upper and lower outer and inner follower rails fixedly secured to the main frame and adapted to carry thereon the outer and inner follower rollers along the upper load and lower return runs, respectively, endless outer and inner tread board chains drivingly connected to the tread board axles near the end portions thereof, side rollers provided on the tread board axles on at least one end thereof with the axes extending orthogonally with respect to the center lines of the tread board axles and such that they bear loads applied to the tread board axles in the direction towards the center of the arcuate conveyor passage, and upper and lower presser rails fixedly secured to the main frame to urge the outer and/or inner drive rollers towards the outer and/or inner drive rails, respectively, whereby the side rollers are adapted to be guided by the upper outer and/or inner drive rails and the lower outer and/or inner presser rails along the upper load run and the lower return run, respectively.

In one of the preferred embodiments of the present invention, the upper outer and inner drive rails as well as the upper outer and inner follower rails are supported on a number of radial horizontal crossbeams fixedly secured to the main frame, and the outer drive rail and the outer follower rail are interconnected by a bracket disposed substantially midway between adjoining crossbeams, increasing the strength and rigidity of these rails.

In accordance with another embodiment, a tension wheel means provided at the lower deflection portion of the conveyor passage comprises an inclined rail device which is adapted to be shifted relative to the main frame and rotatably carries outer and inner sprocket wheels on which the endless outer and inner tread board chains, respectively, are reeved, the inclined rail device itself comprising a frame on which are secured inner horizontal upper and lower rail portions adapted to be slidably connected with the horizontal rail portions of the inner drive rails of the upper load and lower return runs, respectively, at their lower end portions, and upper and lower inclined rail portions are integrally connected to the outer ends of the inner horizontal upper and lower rail portions, respectively, assuring that the inner drive rollers will not derail from the drive rails when the tension wheel means is shifted to compensate for any slack in the endless tread board chain.

BRIEF DESCRIPTION OF THE DRAWINGS

These and other objects of the present invention will become more readily apparent upon reading the following description and upon reference to the accompanying drawings, in which.

DESCRIPTION OF THE PREFERRED EMBODIMENTS

Figure 1:
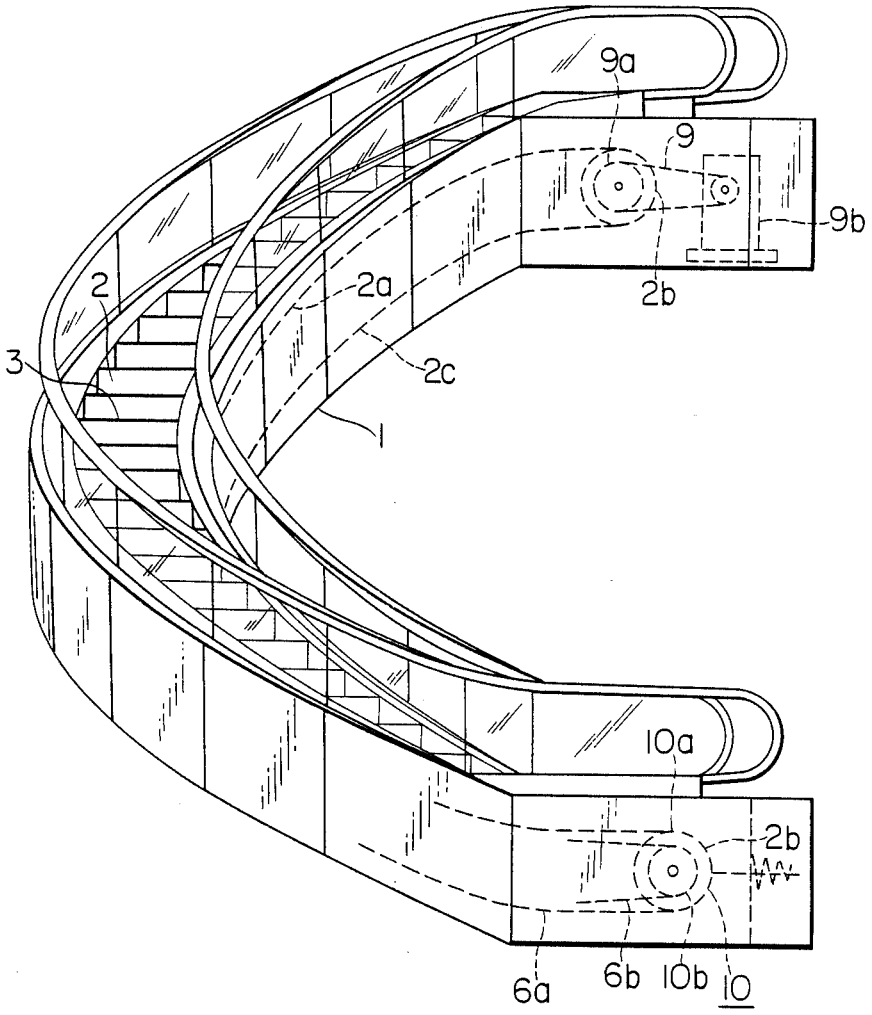
FIG. 1 PRIOR ART
FIG. 1 is a schematic representation of a conventional moving staircase with an arcuate conveyor passage in plan view.
Figure 2:
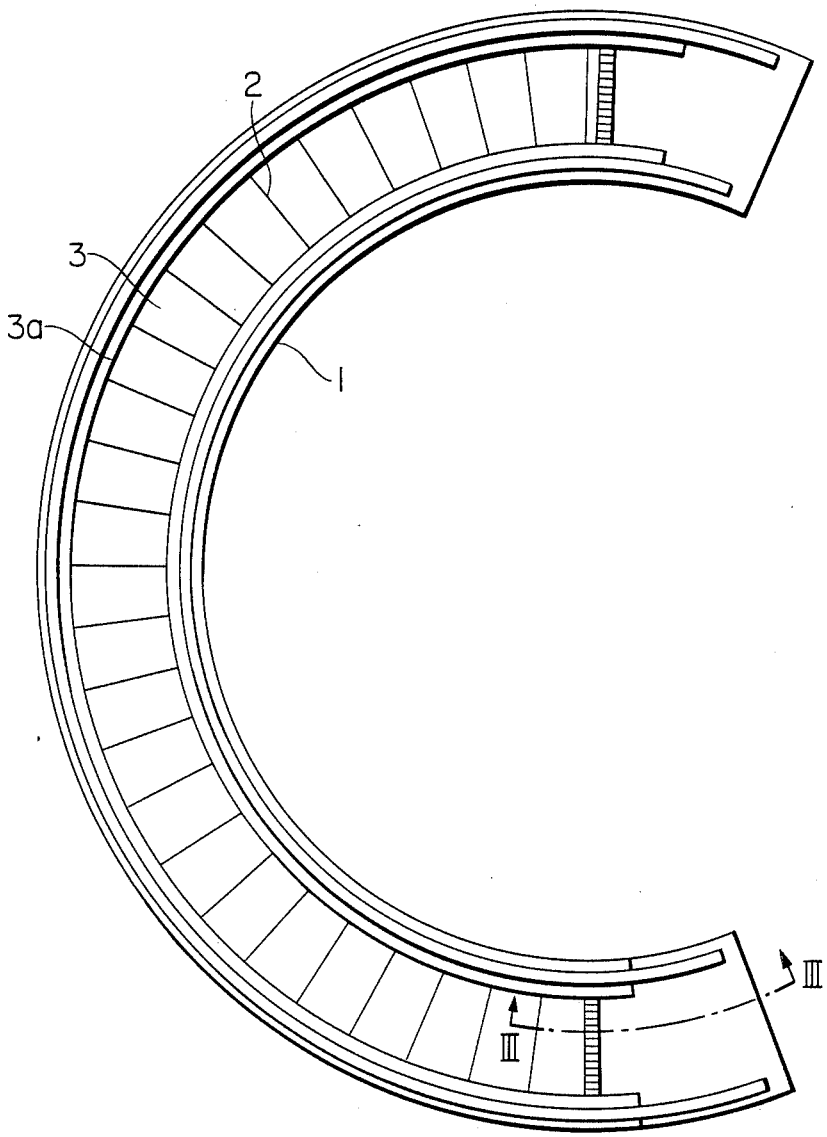
FIG. 2 PRIOR ART
FIG. 2 is a plan view of the moving staircase shown in FIG. 1.
Figure 3:
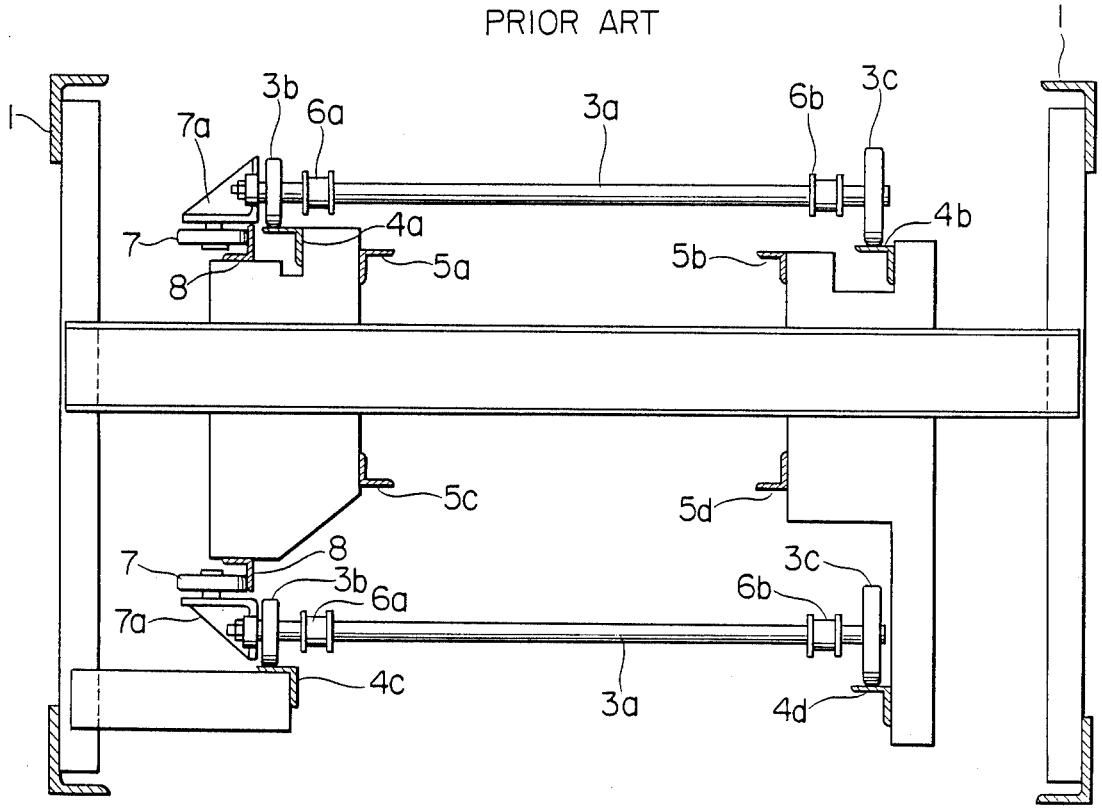
FIG. 3 PRIOR ART
FIG. 3 is a vertical sectional view of the moving staircase shown in FIG. 1 taken along the line III—III of FIG. 2.
Figure 4:
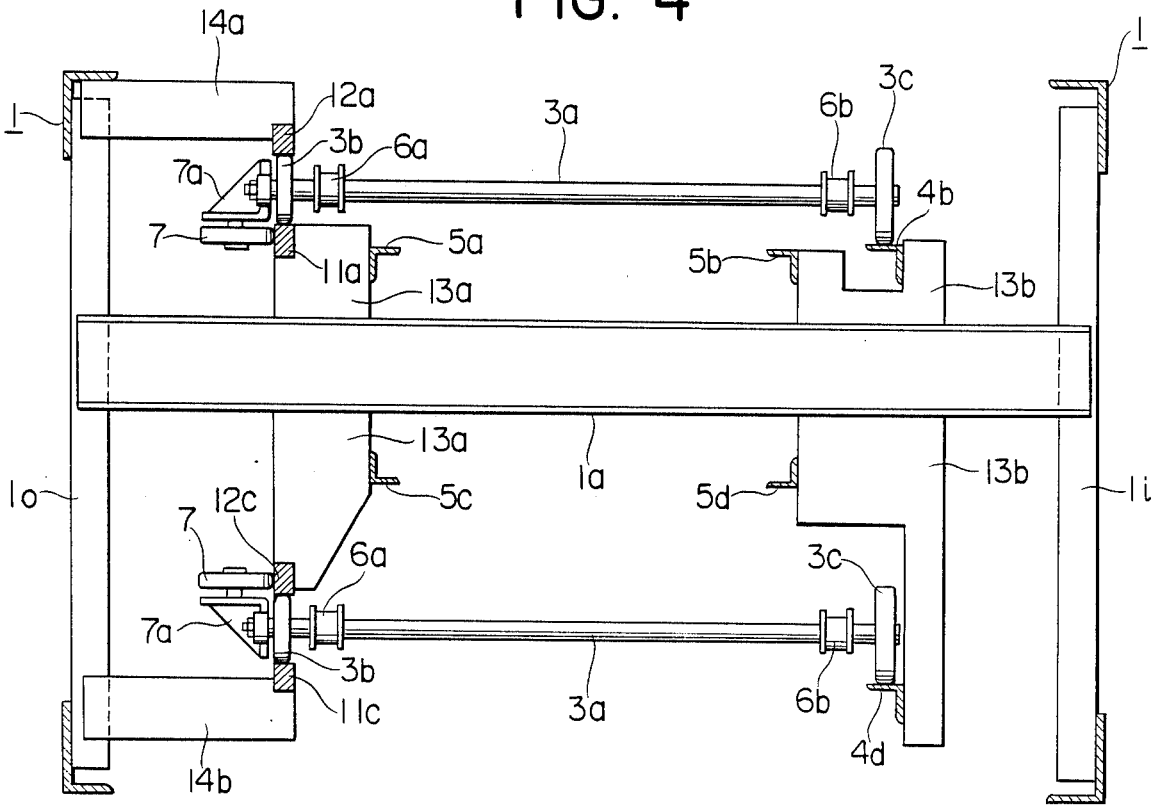
FIG. 4 is a vertical sectional view similar to FIG. 3, but illustrating an embodiment of the present invention.
Figure 5:
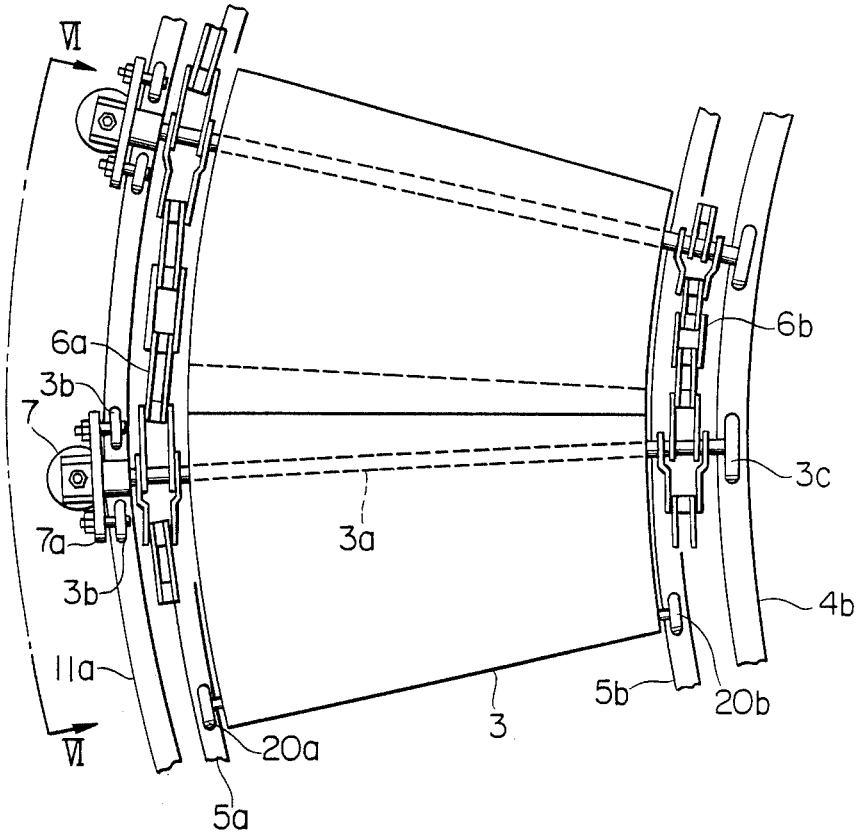
FIG. 5 is a plan view of the essential portion of the embodiment shown in FIG. 4 on a larger scale.
Figure 6:
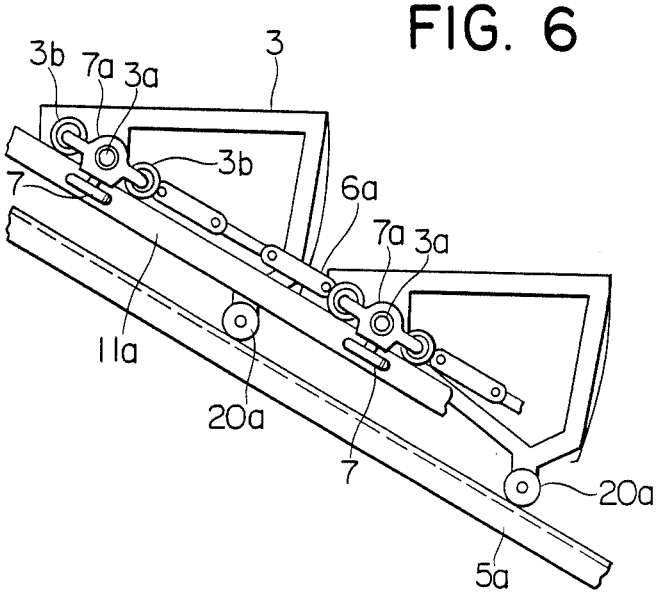
FIG. 6 is a side elevation of the embodiment shown in FIGS. 4 and 5 as viewed in the direction shown by the arrows VI—VI in FIG. 5.
Figure 7:
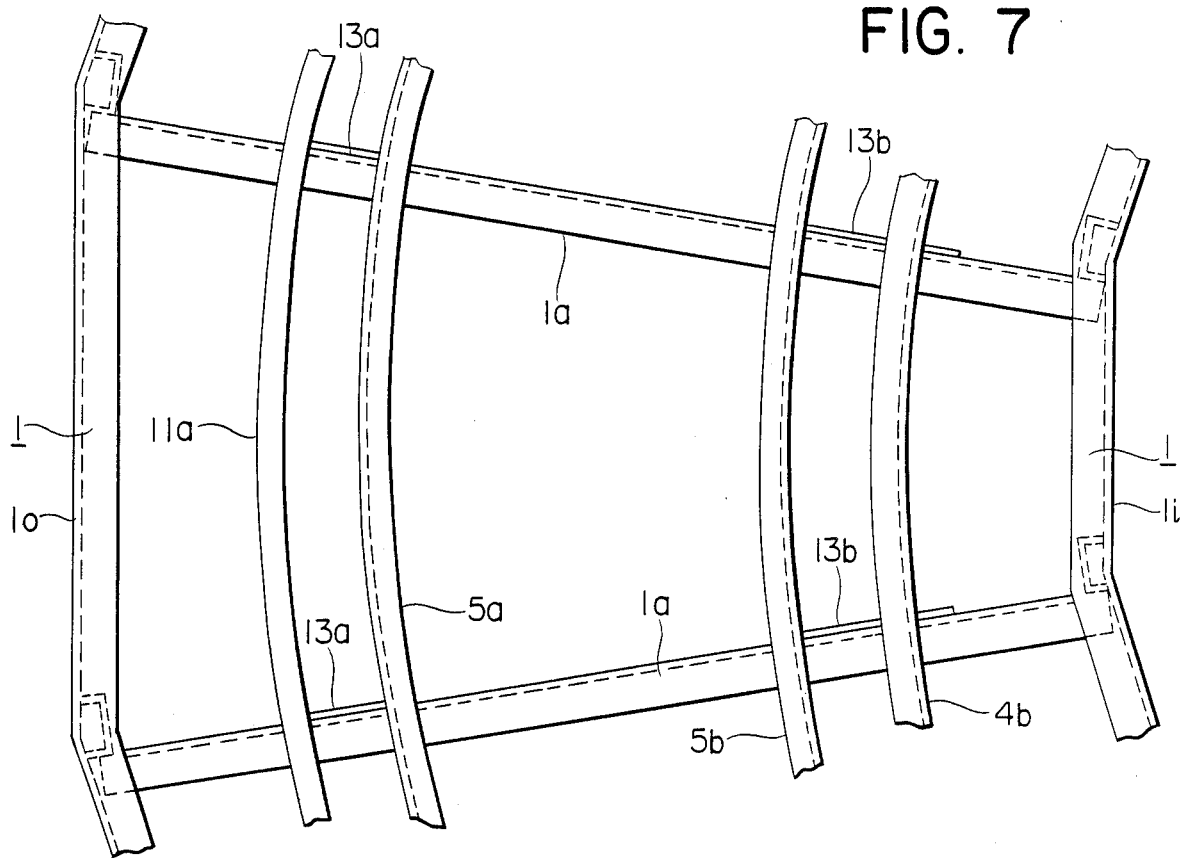
FIG. 7 is a partial plan view of the main frame and the various rail portions of the embodiment shown in FIG. 4 on a larger scale.

Reference is now made to FIGS. 4 to 6 of the attached drawings wherein is shown a first embodiment of the present invention. In these drawings the components indicated by the reference numerals 1, 3*a*, 3*b*, 3*c*, 4*b*, 4*d*, 5*a*, 5*b*, 5*c*, 6*a*, 6*b* and 7 are generally identical to those in a conventional curved moving staircase as described above in reference to FIGS. 1 to 3.

In FIG. 4, reference numeral 11*a* denotes an outer drive rail which is adapted to carry thereon the outer drive rollers 3*b* for the upper load run 2*a* and which is rigidly secured to an outer bracket 13*a* at its upper left corner as viewed in FIG. 4, the bracket 13*a* being integral with the main frame 1. 12*a* denotes a presser rail for the outer drive rollers 3*b* which is adapted to urge them downwards against the outer drive rail 11*a* for the upper load run 2*a* and which is rigidly secured to an upper end bracket 14*a* which is integral with the main frame 1, at its lower right corner as viewed in FIG. 4 so that the presser rail 12*a* is vertically aligned with the outer drive rail 11*a* for the upper load run 2*a*. 11*c* denotes an outer drive rail which is adapted to carry thereon the outer drive rollers 3*b* for the lower return run 2*b* and which is rigidly secured to the main frame 1 through a lower end bracket 14*b* integral therewith at its upper right corner as viewed in FIG. 4. 12*c* denotes a presser rail for the outer drive rollers 3*b* which is adapted to urge them downwards against the outer drive rail 11*c* for the lower return run 2*c* and which is rigidly secured to the outer bracket 13*a* at is lower left corner as viewed in FIG. 4 so that the presser rail 12*c* is vertically aligned with the outer drive rail 11*c* for the lower return run 2*c*.

The side rollers 7 are adapted to be guided by the outer side surface of the outer drive rail 11*a* and the outer side surface of the presser rail 12*c* for the upper load run 2*b* and the lower return run 2*c*, respectively.

Thus, in this first embodiment, should the outer and/or the inner drive rollers 3*b*, 3*c* be subjected to a force urging them upwards the outer drive rollers 3*b* are prevented from being raised up from the surfaces of the outer drive rails 11*a* and 11*c* owing to the existence of the presser rails 12*a* and 12*c*, whereby the derailing of the side rollers 7 from the outer drive rail 11*a* and the presser rail 12*c* is simultaneously prevented by the presser rail 12*a* and the outer drive rail 11*a* for the upper load run 2*a* and by the presser rail 12*c* and the outer drive rail 11*c* for the lower return run 2*c*, respectively.

Although in the above description the presser rails 12*a* and 12*c* are provided at the side of the outer drive rollers 3*b*, it will be apparent that similar effects can be obtained even if the presser rails be provided at the side of the inner drive rollers 3*c*.

It is also conceivable that the presser rails be provided at the sides of both the outer and inner drive rollers 3*b* and 3*c*.

An additional advantage of the first embodiment resides in the fact that although the presser rails 12*a* and 12*c* are provided, since the guide rails for the side rollers 7 are constituted by the outer side surfaces of the drive rail 11*a* or the presser rail 12*c*, the number of rails employed is no greater than in a conventional moving staircase.

At this point, for the purpose of providing a better understanding of the improvement in accordance with the present invention in the support system for the various rails in the embodiment shown in FIGS. 4 to 6, the construction of the main frame 1 together with its associated members will be explained more fully in reference to FIGS. 4 to 7.

As shown in these figures, the outer and inner vertical members 1*o* and 1*i* constituting the outer and inner strength members of main frame 1, respectively, are rigidly connected together by a number of radial main frame cross-beams 1*a* which are disposed between the vertical members 1*o* and 1*i*, the vertical members being disposed at suitable intervals along the conveyor passage 2. The outer and inner brackets 13*a* and 13*b* are secured to the main frame crossbeams 1*a* at positions corresponding to the outer drive rails 11*a* and the inner drive rails 4*b*, respectively. The outer bracket 13*a* also supports the outer follower rails 5*a*, 5*c*, and the presser rail 12*c*, while the inner bracket 13*b* supports the inner drive rails 4*b*, 4*d* and the inner follower rails 5*b*, 5*d*. The outer member 1*o* of the main frame 1 is further provided with the upper end bracket 14*a* and the lower end bracket 14*b* at its upper and lower end portions, respectively, and the upper and lower end brackets 14*a* and 14*b* rigidly mount the presser rail 12*a* and the outer drive rail 11*c*, respectively.

With such a construction of the main frame 1 together with its associated members, since the outer drive rail 11*a* and the lower presser rail 12*c* are subjected to large forces through the side rollers 7 during the operation of the moving staircase, in order to resist the forces, the dimensions of the rails 11*a* and 12*c* must be made large, and at the same time the spacing between adjoining main frame crossbeams 1*a*, and thus the spacing between adjacent outer brackets 13*a*, inner brackets 13*b*, upper end brackets 14*a*, and lower end brackets 14*b*, as measured along the conveyor passage 2, must be decreased so that the support spans of the rails 11*a*, 12*c*, etc. are made small. However, such a measure causes the installation cost of the moving staircase to be high.

The improvement of the present invention to remedy this difficulty resides in as follows.

Figure 8:
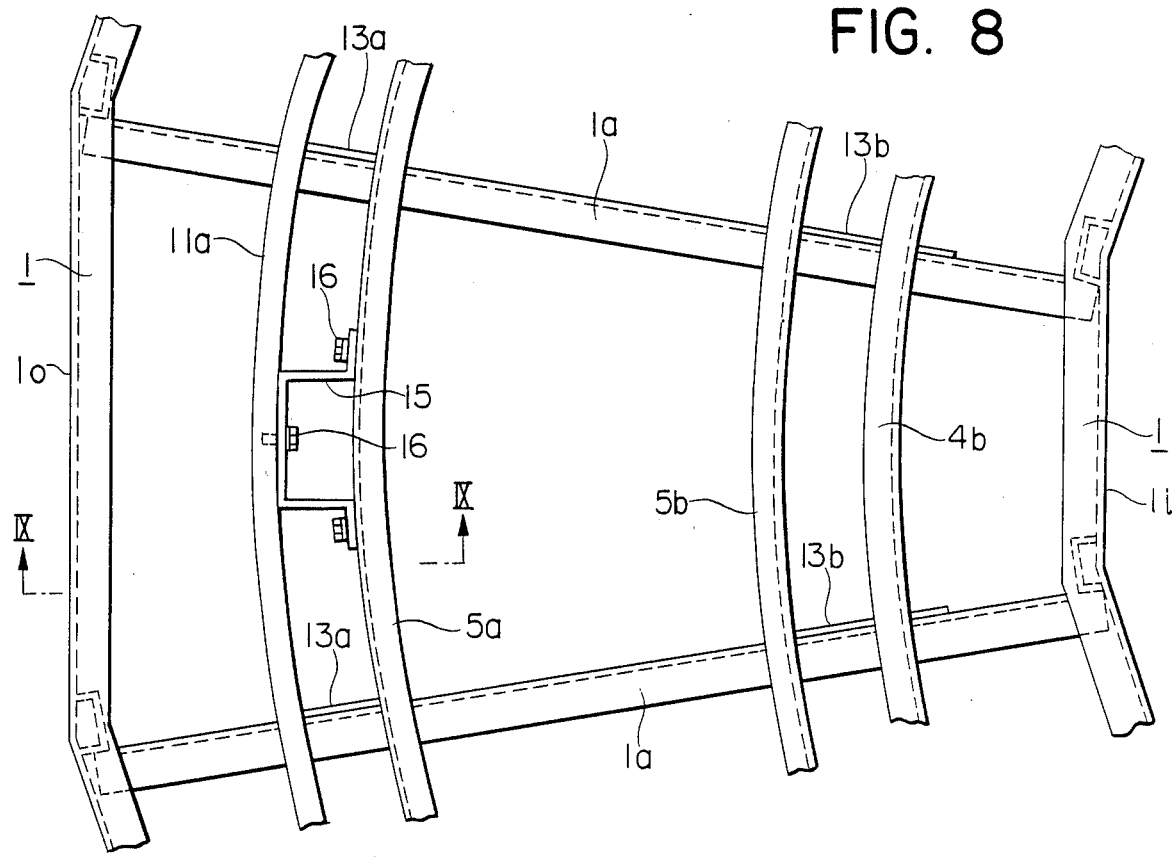
FIG. 8 is a partial plan view similar to FIG. 7, but illustrating another embodiment of the present invention.
Figure 9:
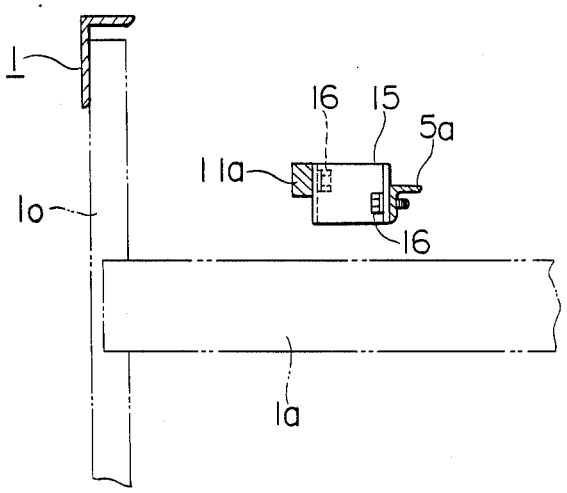
FIG. 9 is a sectional view of FIG. 8 taken along the line IX—IX in FIG. 8.

In the second embodiment of the present invention, as shown in FIGS. 8 and 9, a squared off U-shaped bracket 15 is disposed between the outer drive rail 11*a* and the upper outer follower rail 5*a* substantially midway between adjoining outer brackets 13*a*, the bracket 15 being rigidly secured to the rails 11*a* and 5*a* by bolts 16 or the like.

With such a measure the thrust applied to the outer drive rail 11*a* through the rotating side rollers 7 can be born also by the outer follower rail 5*a* through the brackets 15 disposed therebetween. Thus, since the thrust from the side rollers 7 can be carried not only by the outer drive rail 11*a* but also by the upper outer follower rail 5*a*, sufficient strength and rigidity of the outer drive rail 11*a* can be achieved without it being necessary to increase the cross section thereof or to decrease the spacing between adjoining outer brackets 13*a*.

Although in the improvement just described the bracket 15 is described as being disposed only between the outer drive rail 11*a* and the upper outer follower rail 5*a* in the upper load run 2*a*, a similar bracket may also be provided between the lower presser rail 12*c* and the lower outer follower rail 5*c* in the lower return run 2*c*. Further, if the inner drive rail 4*b* is designed to have a cross sectional configuration similar to that of the outer drive rail 11*a* and if the side rollers 7 are provided so as to roll on the outer periphery of the inner drive rail 4*b*, a similar bracket may be provided between the inner side drive rail 4*b* and the inner follower rail 5*b*.

Next the tension wheel means to be provided at the lower deflection portion 2*b* of the conveyor passage 2 which is constructed in accordance with the present invention will be described in reference to FIGS. 10 to 14 as a third embodiment thereof.

Figure 10:
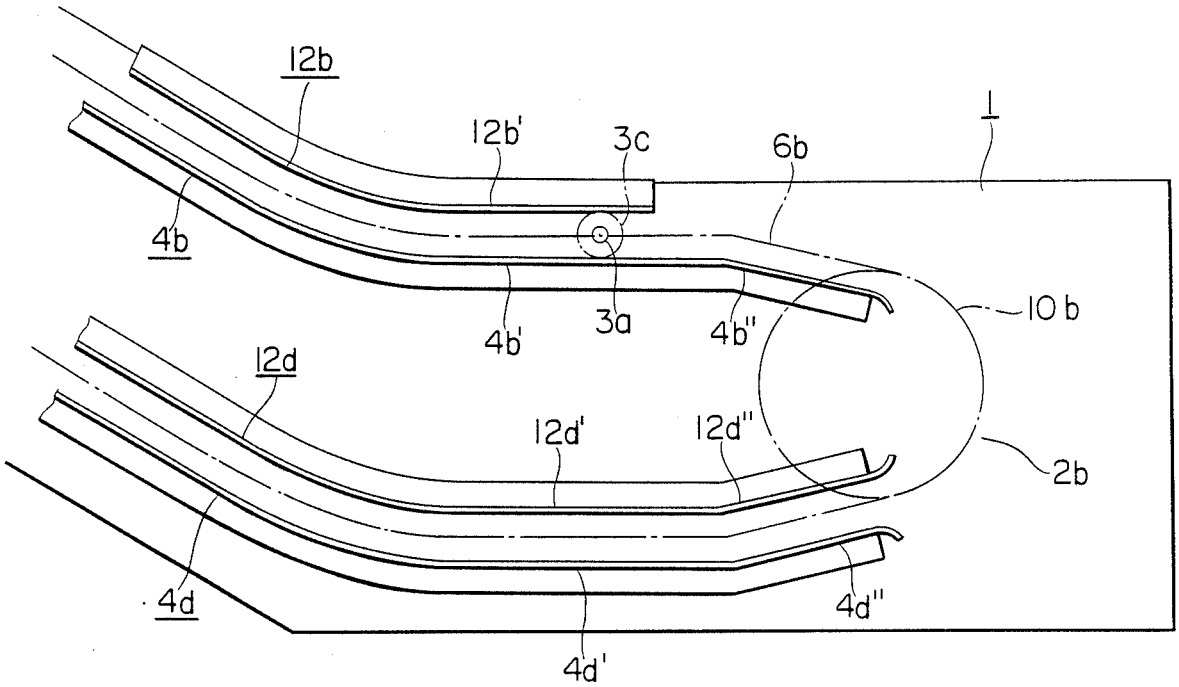
FIG. 10 is a partial side elevation of the tension wheel means shown in FIG. 1, but also partially illustrating the presser rails in accordance with the present invention.
Figure 11:
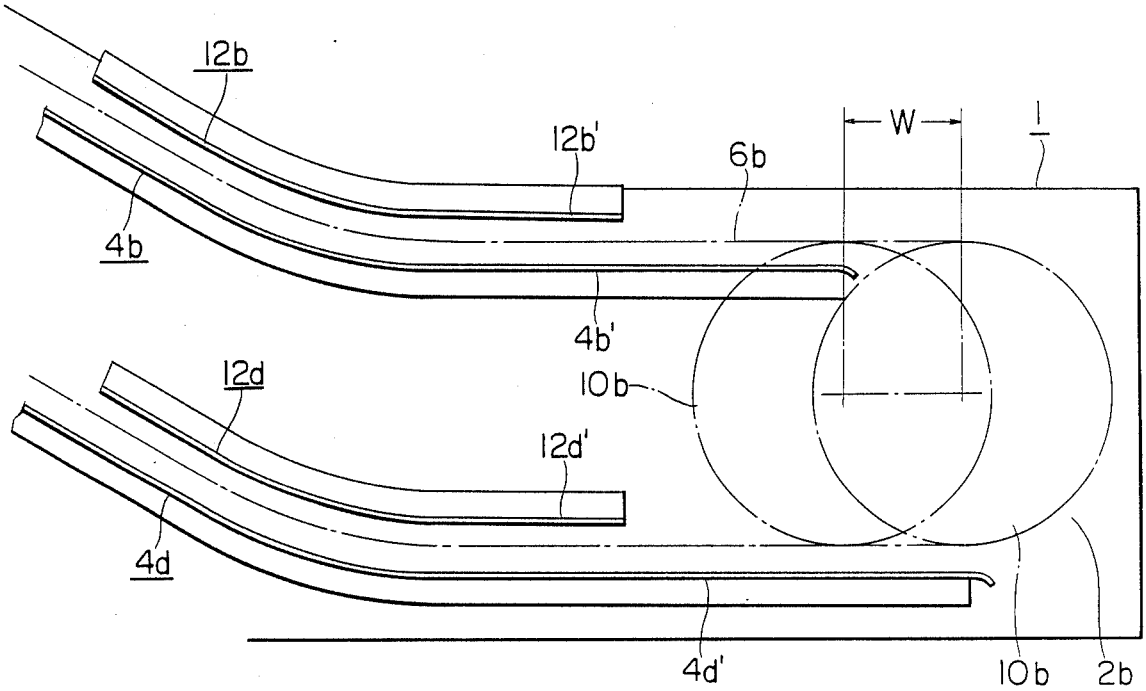
FIG. 11 is a partial side elevation similar to FIG. 10, but illustrating partially the state after the tension wheel means is shifted in the part of the structure thereof corresponding to a conventional moving staircase with a straight conveyor passage.

As was previously explained in reference to FIGS. 10 to 11, in a conventional curved moving staircase, the inner drive rollers 3*c* tend to derail from the surfaces of the inner drive rails 4*b* and 4*d* at the lower deflection portion 2*b* when the tension wheel means 10, i.e. the inner sprocket wheel 10*b* is linearly moved longitudinally outwards relative to the conveyor passage 2. At the lower deflection portion 2*b* the rails 4*b* and 4*d* comprise the horizontal rail portion 4*b*′ and 4*d*′ and the downwardly and upwardly inclined rail portion 4*b*″ and 4*d*″.

Figure 12:
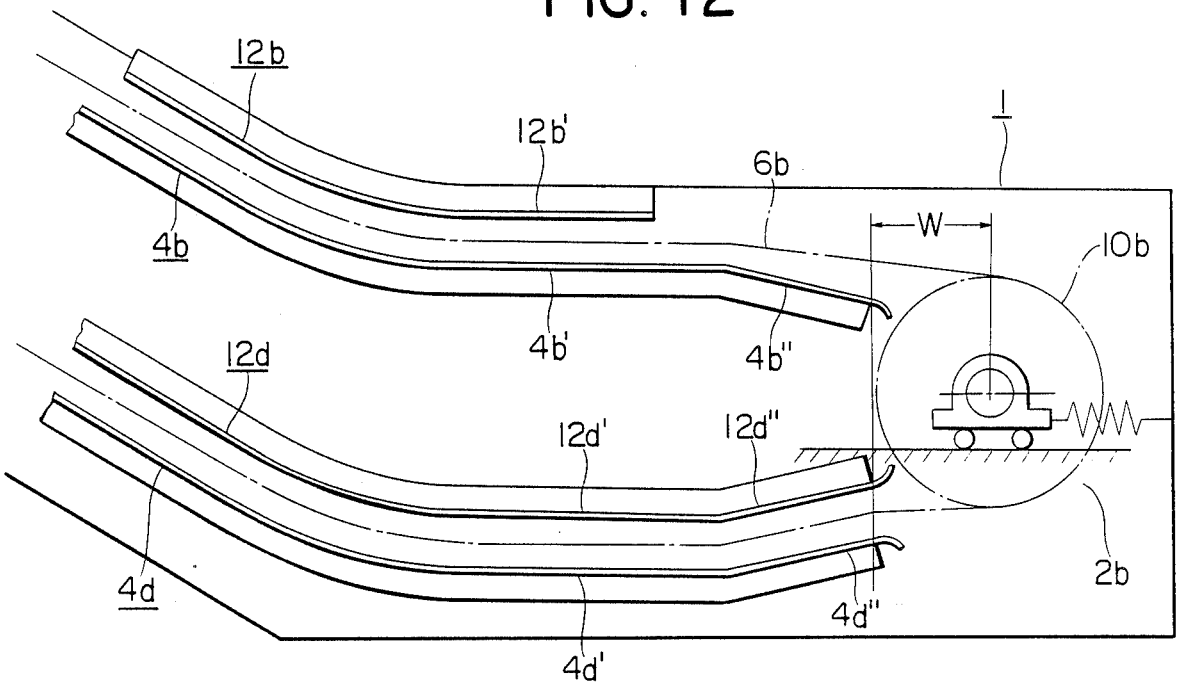
FIG. 12 is a partial side elevation similar to FIG. 10, but illustrating the state after the tension wheel means is shifted relative to the main frame.
Figure 13:
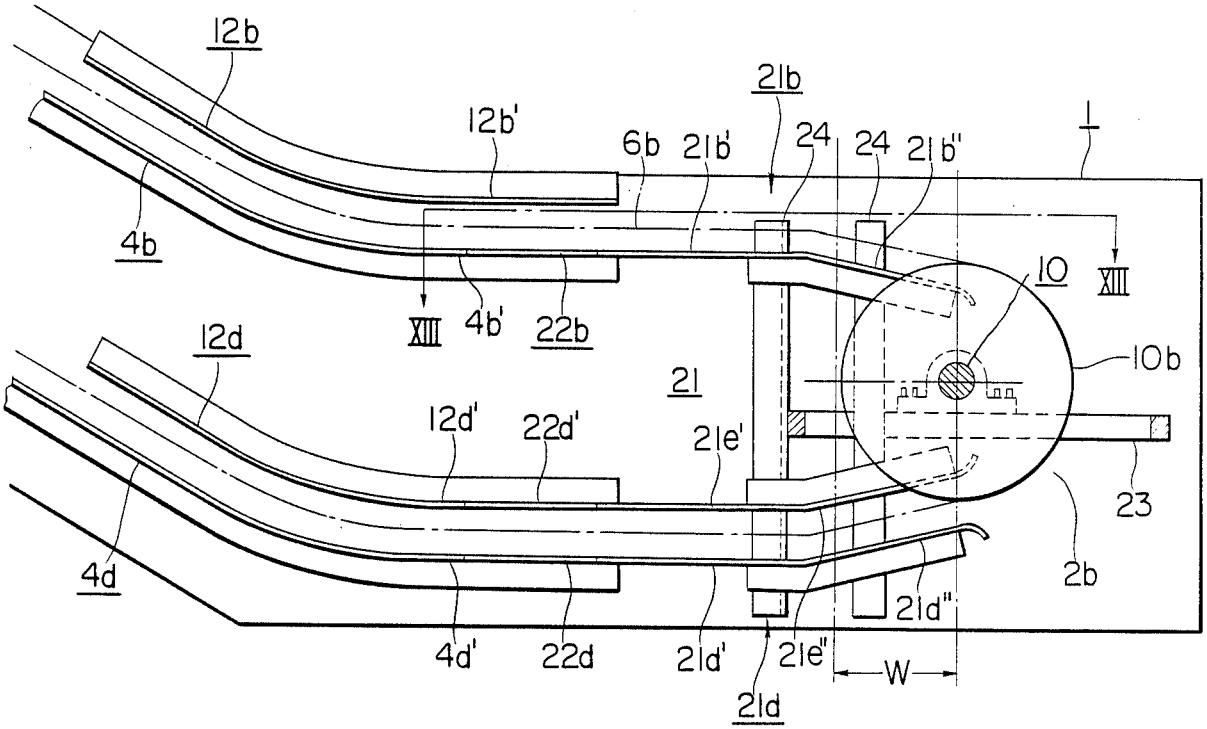
FIG. 13 is a partial side elevation similar to FIG. 11, but illustrating the provision of the inclined rail device in accordance with the present invention.

Therefore, in accordance with the present invention, for the purpose of remedying this phenomenon, as shown in FIGS. 12 and 13, which shows the part of the structure on the inner side of the staircase at the lower deflection portion 2*b* there is provided an inclined rail device 21 which is positioned between the horizontal rail portions 4*b*′ and 4*d*′ of the inner drive rails 4*b* and 4*d* of the upper load and lower return runs 2*a* and 2*c*, respectively, and the inner sprocket wheel 10*b*, and which is adapted to be horizontally shiftable. The inclined rail device 21 comprises a horizontal upper rail portion 21*b*′ which is slidably connected with the horizontal rail portion 4*b*′ through a sliding joint 22*b* with their upper surfaces being flush with each other, a horizontal lower rail portion 21*d*′ which is slidably connected with the horizontal rail portion 4*d*′ through a similar sliding joing 22*d*, an upper inclined rail portion 21*b*″ which is connected to the outer end of the horizontal rail portion 21*b*′, and a lower inclined rail portion 21*d*″. The upper inclined rail portion 21*b*″ slopes downwards substantially towards the center of the inner sprocket wheel 10*b*, whereas the lower inclined rail portion 21*d*″ slopes upwards substantially towards the center of the inner sprocket wheel 10*b*. The inclined rail device 21 is rigidly connected to the frame 23 of the inner sprocket wheel 10*b* by brackets 24 through any suitable fastening means (not shown), the frame 23 being mounted on the main frame 1 so as to be shiftable relative thereto.

With such a construction of the inclined rail device 21, even if the frame 23 is moved outwards a distance W relative to the main frame 1 as shown in FIG. 13 in order to compensate for the elongation of the endless tread board chain 6*b* due to wear, etc., the inclined rail device 21 is also moved the same distance W together with the frame 23 through any suitable means, and no relative change in position between the inner tread board chain 6*b* and the rail portions 4*b*′, 21*b*′, 21*b*″, 4*d*′, 21*d*′ and 21*d*″ occurs.

Therefore, it will be apparent that no change in the relative position between the rails 4*b*, 4*d*, 4*b*′, 4*d*′, 21*b*′ 21*b*″, 21*d*′ and 21*d*″ at the lower deflection portion 2*b* and the endless inner tread board chain 6*b* occurs regardless of the shift of the inner sprocket wheel 10*b*. Thus, the movement of the endless inner tread board chain 6*b* is always kept stable, overcoming the difficulties in the conventional curved moving staircase as described above.

At this point it should be noted that in FIG. 13 it is assumed that at the inner side of the conveyor passage 2 there are provided presser rails 12*b* and 12*d* in addition to or in place of the presser rails 12*a* and 12*c* provided at the outer side of the conveyor passage 2, the presser rails 12*b* and 12*d* having similar shapes to those of the presser rails 12*a* and 12*c*, respectively, and that the presser rail 12*b* terminates in a horizontal rail portion 12*b*′ substantially at the position of the horizontal rail portion 4*b*′ of the inner drive rail 4*b*, and the presser rail 12*d* connects to a horizontal rail portion 12*d*′ substantially in parallel with the horizontal rail portion 4*d*′. The horizontal rail portion 12*d*′ is adapted to be shiftably connected to the horizontal rail portion 21*e*′ of the inclined rail device 21 through a sliding joint 22*d*′ similar to the sliding joint 22*b* for the horizontal upper rail portion 21*b*′, and the horizontal rail portion 21*e*′ is rigidly mounted on the inclined rail device 21 together with an inclined rail portion 21*e*″ which is integral with the horizontal rail portion 21*e*′ and substantially in parallel with the inclined rail portion 21*d*″.

It will be understood that duplicate structure is provided on the outer side of the staircase for tread board chain 6*a*, and that frame 23 moves both sprocket wheels 10*b* and 10*a* together.

Finally, as another embodiment of the present invention a variation of the first embodiment will be explained with reference to FIGS. 15 and 16.

As publicly known in the art, in a curved moving staircase of this kind, the upper surfaces of the tread boards 3 are always maintained horizontal while they move along the upper load run 2*a* of the conveyor passage 2. In this case, the follower rails 5*a* and 5*b* in the upper load run 2*a* function to carry the load of the passengers getting on the tread boards 3 together with the upper and lower outer drive rails 11*a* and 11*c*, while the lower outer and inner follower rails 5*c* and 5*d* in the lower return run 2*c* function to maintain the attitude of the tread boards 3. In this case, since the follower rails 5*c* and 5*d* in the lower return run 2*c* do not carry the load of the passengers, the attitude of the tread boards 3 can be maintained just as well even when only one of the follower rollers 20*a* or 20*b* is supported by one of the follower rails 5*c* or 5*d*, no need being required for both the follower rails 5*c* and 5*d* to be provided over the whole moving range of the follower rollers 20*a*, 20*b*.

Figure 15:
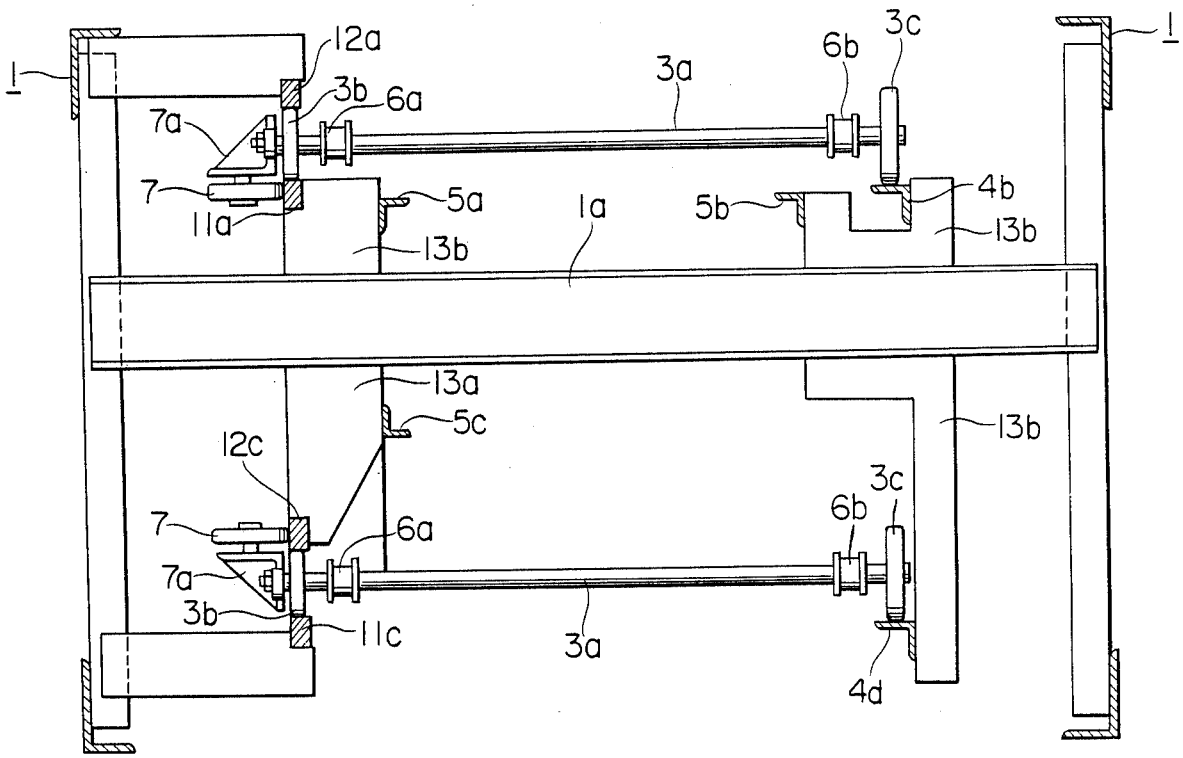
FIG. 15 is a vertical sectional view similar to FIG. 4, but illustrating a variant form of the embodiment shown therein.
Figure 16:
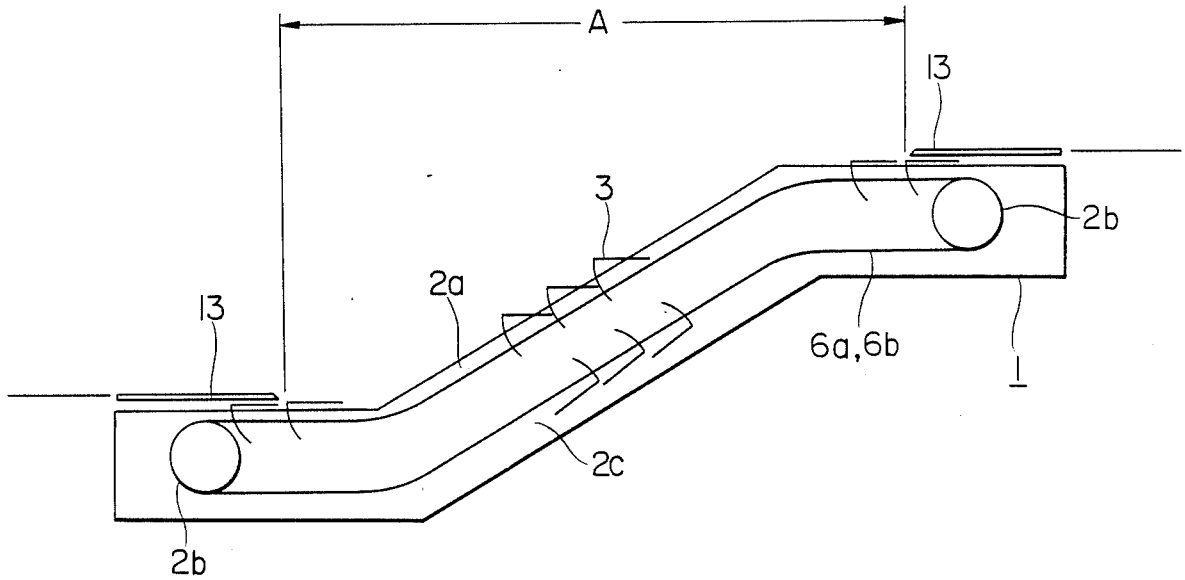
FIG. 16 is a schematic exploded side elevation of a moving staircase as a whole to illustrate the state of the tread boards while they move along the upper load and lower return runs.
Figure 17:
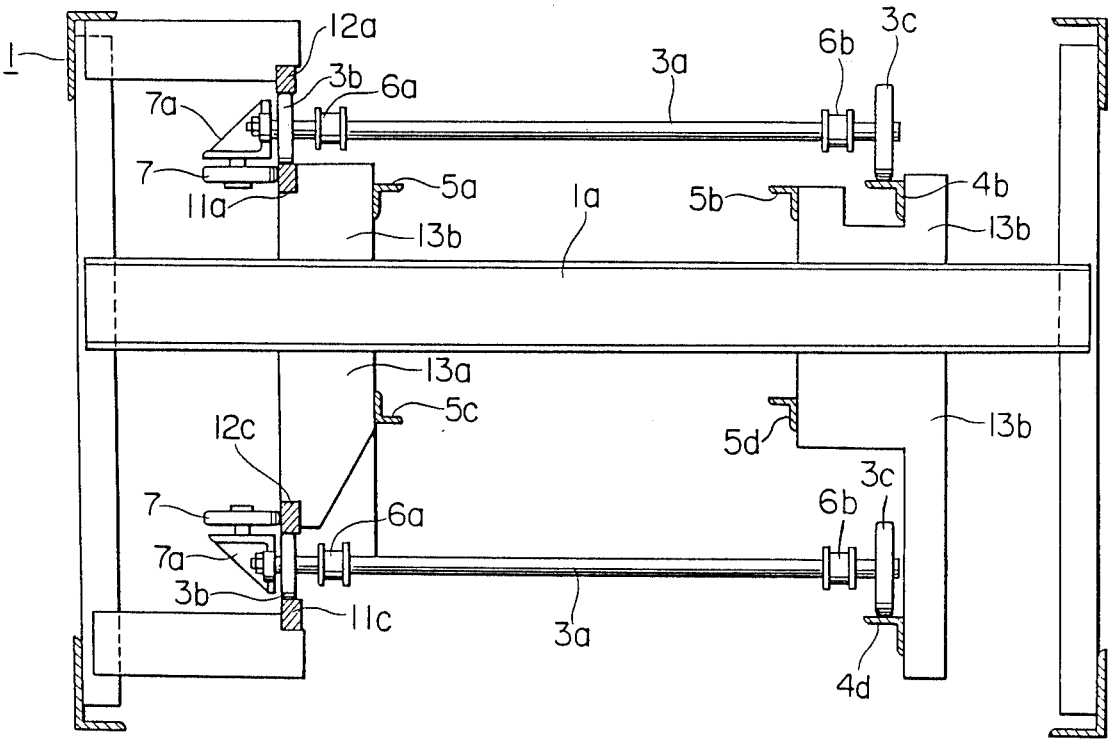
FIG. 17 is a view similar to FIG. 15 illustrating a variant thereof.

From this point of view, as shown in FIGS. 15 and 16, the lower inner follower rail 5*d*, shown in FIG. 4, is omitted.

At this point it should be noticed that, as shown in FIG. 16, since the tread boards 3 in the upper load run 2*a* in Section A have passengers thereon, it is necessary that the rollers 3*b*, 3*c*, 20*a*, 20*b* and 7 be guided by the corresponding rails 11*a*, 4*b*, 5*a*, 5*b*, and 11*a* so as to carry the load of the passengers, but, at any section other than Section A, since the tread boards 3 carry no load, the attitude of the tread boards 3 can be maintained even if the lower inside follower rail 5*d* is omitted, and the same safety level as in the conventional curved moving staircase is maintained.

Figure 14:
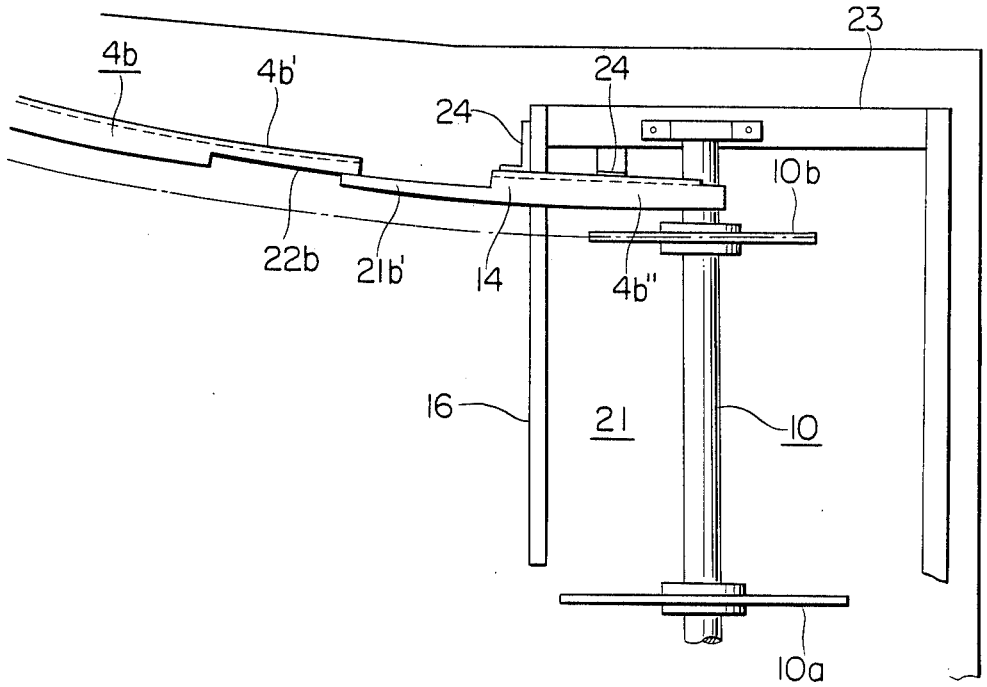
FIG. 14 is a plan view of the inclined rail device shown in FIG. 13 as viewed in the direction shown by the arrows XIV—XIV of FIG. 13.
Figure 18:
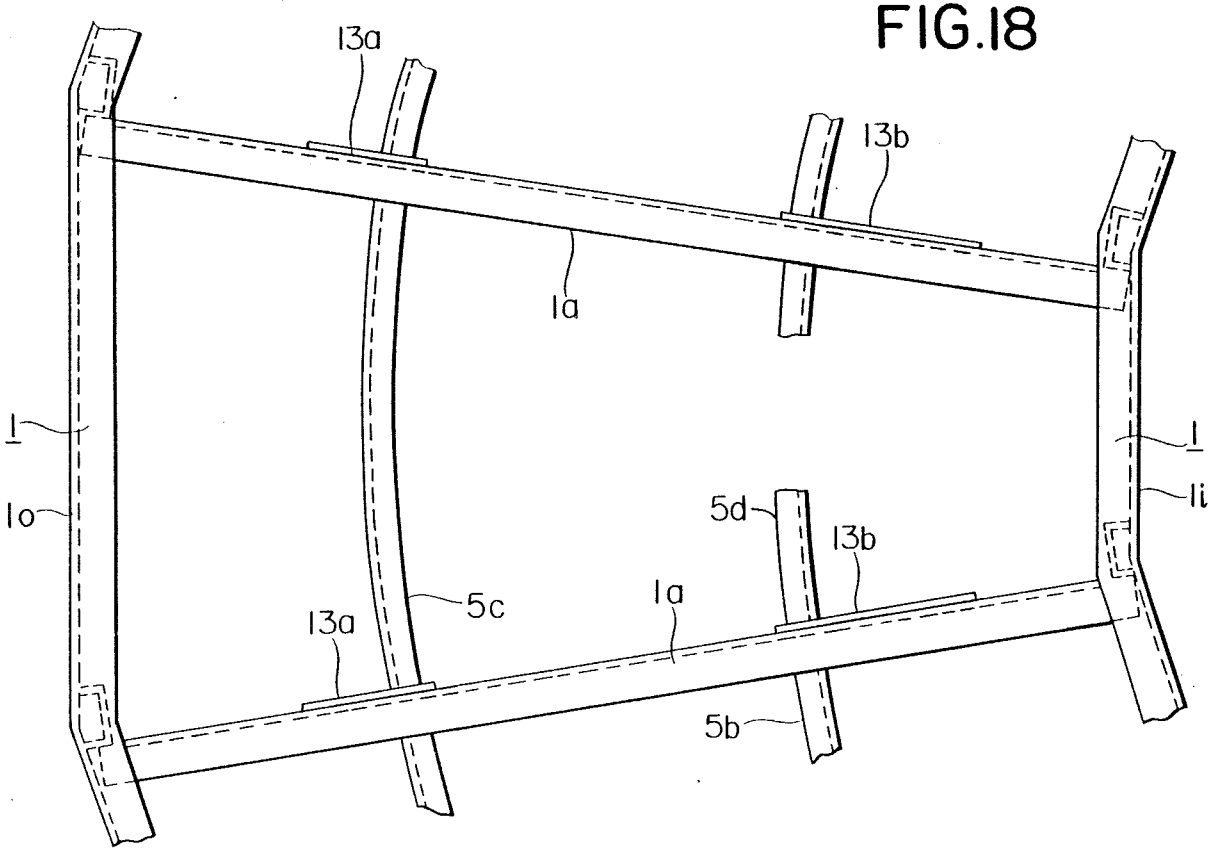
FIGS. 18–20 are partial plan views of the main frame and certain rail portions showing variants of the rail structure.
Figure 19:
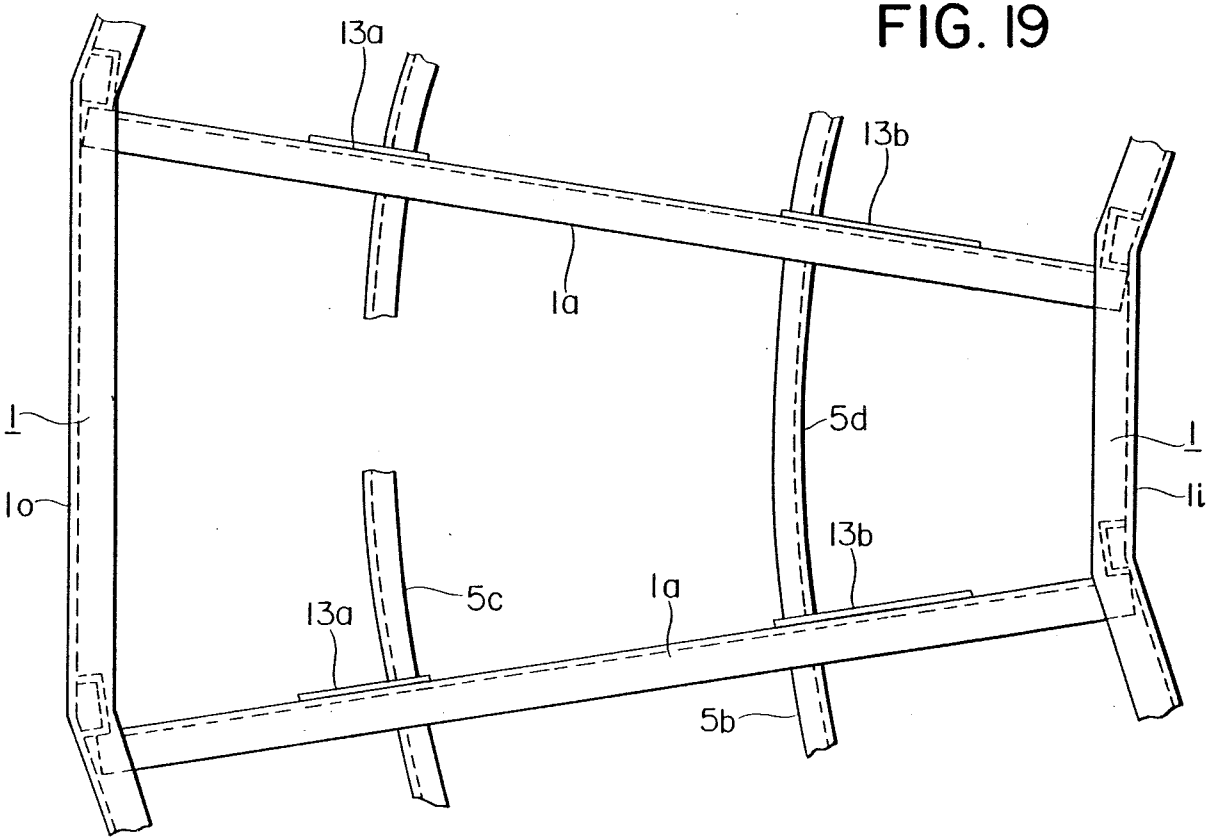
Figure 20:
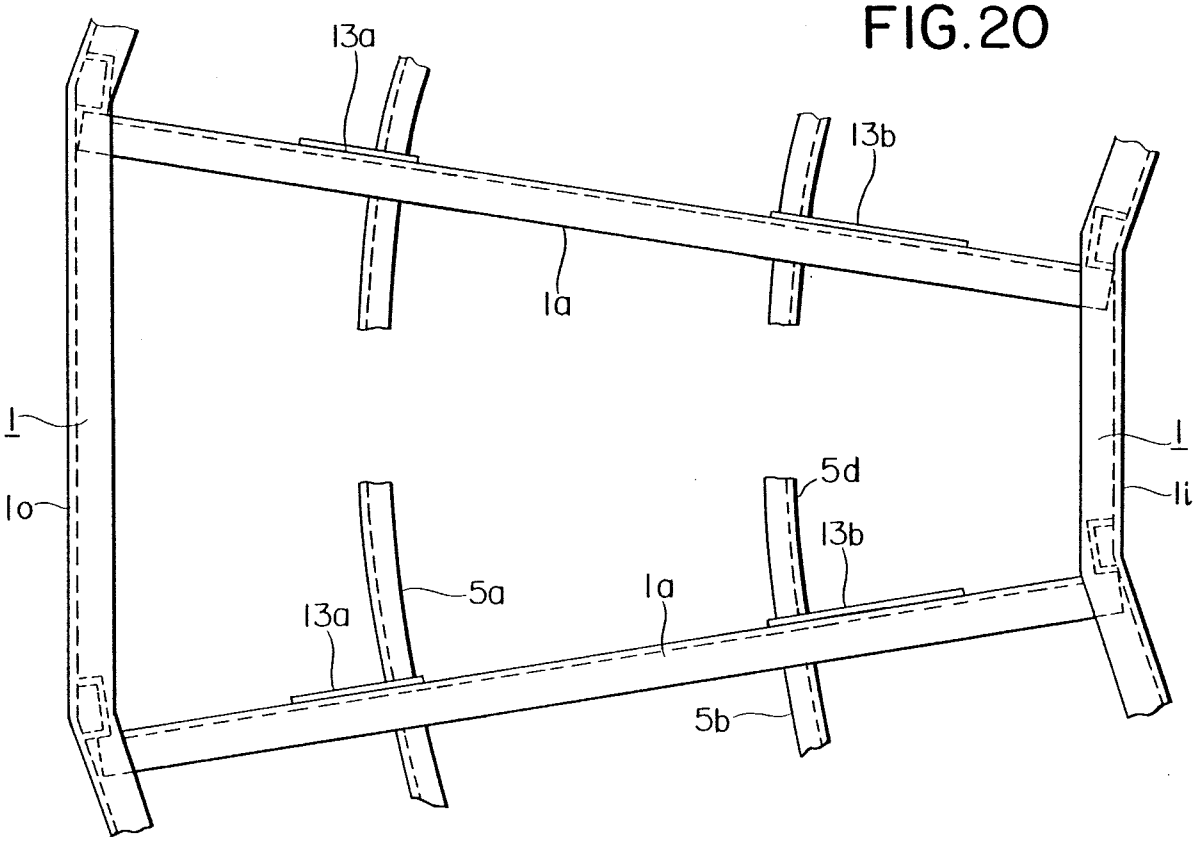

Although in the above variation the lower inner follower rail 5*d* is omitted, it is, of course, possible to omit the lower outer follower rail 5*c*, as shown in FIG. 14, and further the lower follower rail 5*c* or 5*d* need not be provided over the whole moving range of the follower roller 20*a* or 20*b*, as shown in FIGS. 18–20. Instead they may be provided only at several necessary locations so long as they provide a continuous passage for the follower rollers 20*a* and 20*b* as a whole.

It is to be understood that although certain forms of the present invention have been illustrated and described it is not to be limited thereto except insofar as such limitations are included in the following claims.

What is claimed is:

1. A curved moving staircase structure with a curved conveyor path having a substantially arcute configuration in plan view, said structure comprising:

a main frame having an outer frame member disposed along the outer periphery of said arcuate conveyor path, an inner frame member disposed along the inner periphery of said arcuate conveyor path, a plurality of radial crossbeams which are disposed at intervals along said conveyor path so as to diverge radially from the center of said arcuate conveyor path and which rigidly connect said outer and inner frame members, an outer bracket rigidly connected to each of said cross-beams, an inner bracket rigidly connected to each of said cross-beams;

a plurality of tread boards articulated in an endless loop and shiftably supported on said main frame for circulating along said arcuate conveyor path and having an upper load run, a lower return run, and horizontal upper and lower deflection portions connecting said upper and lower runs together at the upper and lower ends of said path, respectively;

a tread board axle for each tread board and on which the corresponding tread board is swingably mounted, each axle extending transversely to the direction of movement of said tread boards along said path;

outer and inner drive rollers rotatably mounted on each of the tread board axles near the outer and inner end portions, respectively;

upper and lower outer and inner drive rails along said path on which said outer and inner drive rollers are rollably supported in said upper load and lower return runs, the upper outer drive rail being mounted on the outer brackets and said upper inner drive rail being mounted on the inner brackets;

outer and inner follower rollers rotatably mounted on each of said tread boards at both sides thereof;

upper outer and inner follower rails along said path on which said outer and inner follower rollers are rollably supported in said upper load run, the upper outer follower rail being mounted on the outer brackets in laterally spaced relation to said upper outer drive rail and the upper inner follower rail being mounted on the inner brackets in laterally spaced relation to said upper inner drive rail;

outer and inner tread board chains drivingly connecting said tread board axles near their outer and inner end portions, respectively;

upper and lower presser rails fixedly secured to said main frame and extending along and spaced above at least one of said inner and outer upper and lower drive rails and engaging the corresponding drive rollers and limiting the movement of the drive rollers away from the corresponding drive rails;

a side roller mounted on only one end of each of said tread board axles with the rotational axis thereof extending orthogonally with respect to the tread board axles, the upper drive rail and lower presser rail at the ends of the tread board axles corresponding to the position of said side rollers, said upper drive rail and lower presser rail having lateral faces facing away from the center of said arcuate conveyor path, said side rollers engaging said lateral faces of the corresponding upper drive rail and lower presser rail along said upper load and lower return runs, respectively, in a direction for supporting the load applied to said tread board axles in the direction toward the center of said arcuate conveyor path and a connecting bracket disposed between the pair of said upper outer drive rail and said upper outer follower rail substantially midway between adjacent outer brackets, said connecting bracket rigidly connecting said rail pair together and bracing the drive rail of the pair against the lateral thrust force of said side rollers.

2. A structure as claimed in claim 1 further comprising a lower outer follower rail secured to said main frame along the lower return run on which said outer follower roller moves.

3. A structure as claimed in claim 1 further comprising a lower inner follower rail secured to said main frame along the lower return run on which said inner follower roller moves.

4. A curved moving staircase structure with a curved conveyor path having a substantially arcuate configuration in plan view, said structure comprising:

a main frame having an outer frame member disposed along the outer periphery of said arcuate conveyor path, an inner frame member disposed along the inner periphery of said arcuate conveyor path, a plurality of radial crossbeams which are disposed at intervals along said conveyor path so as to diverge radially from the center of said arcuate conveyor path and which rigidly connect said outer and inner frame members, an outer bracket rigidly connected to each of said crossbeams, an inner bracket rigidly connected to each of said crossbeams;

a plurality of tread boards articulated in an endless loop and shiftably supported on said main frame for circulating along said arcuate conveyor path and having an upper load run, a lower return run, and horizontal upper and lower deflection portions connecting said upper and lower runs together at the upper and lower ends of said path, respectively;

a tread board axle for each tread board and on which the corresponding tread board is swingably mounted, each axle extending transversely to the direction of movement of said tread boards along said path;

outer and inner drive rollers rotatably mounted on each of the tread board axles near the outer and inner end portions, respectively;

upper and lower outer and inner drive rails along said path on which said outer and inner drive rollers are rollably supported in said upper load and lower return runs, the upper outer drive rail being mounted on the outer brackets and said upper inner drive rail being mounted on the inner brackets;

outer and inner follower rollers rotatably mounted on each of said tread boards at both sides thereof;

upper outer and inner follower rails along said path on which said outer and inner follower rollers are rollably supported in said upper load run, the upper outer follower rail being mounted on the outer brackets is laterally spaced relation to said upper outer drive rail and the upper inner follower rail being mounted on the inner brackets in laterally spaced relation to said upper inner drive rail;

a lower outer intermittent follower rail secured to said main frame along the lower return run on which said outer follower roller moves;

outer and inner tread board chains drivingly connecting said tread board axles near their outer and inner end portions, respectively;

upper and lower presser rails fixedly secured to said main frame and extending along and spaced above at least one of said inner and outer upper and lower drive rails and engaging the corresponding drive rollers and limiting the movement of the drive rollers away from the corresponding drive rails;

a side roller mounted on only one end of each of said tread board axles with the rotational axis thereof extending orthogonally with respect to the tread board axles, the upper drive rail and lower presser rail at the ends of the tread board axles corresponding to the position of said side rollers, said upper drive rail and lower presser rail having lateral faces facing away from the center of said arcuate conveyor path, said side rollers engaging said lateral faces of the corresponding upper drive rail and lower presser rail along said upper load and lower return runs, respectively, in a direction for supporting the load applied to said tread board axles in the direction toward the center of said arcuate conveyor path and a connecting bracket disposed between the pair of said upper outer drive rail and said upper outer follower rail outer brackets, said connecting bracket rigidly connecting said rail pair together and bracing the drive rail of the pair against the lateral thrust force of said side rollers.

5. A curved moving staircase structure with a curved conveyor path having a substantially arcuate configuration in plan view, said structure comprising:

a main frame having an outer frame member disposed along the outer periphery of said arcuate conveyor path, an inner frame member disposed along the inner periphery of said arcuate conveyor path, a plurality of radial crossbeams which are disposed at intervals along said conveyor path so as to diverge radially from the center of said arcuate conveyor path and which rigidly connect said outer and inner frame members, an outer bracket rigidly connected to each of said crossbeams, an inner bracket rigidly connected to each of said crossbeams;

a plurality of tread boards articulated in an endless loop and shiftably supported on said main frame for circulating along said arcuate conveyor path and having an upper load run, a lower return run, and horizontal upper and lower deflection portions connecting said upper and lower runs together at the upper and lower ends of said path, respectively;

a tread board axle for each tread board and on which the corresponding tread board is swingably mounted, each axle extending transversely to the direction of movement of said tread boards along said path;

outer and inner drive rollers rotatably mounted on each of the tread board axles near the outer and inner end portions, respectively;

upper and lower outer and inner drive rails along said path on which said outer and inner drive rollers are rollably supported in said upper load and lower return runs, the upper outer drive rail being mounted on the outer brackets and said upper inner drive rail being mounted on the inner brackets;

outer and inner follower rollers rotatably mounted on each of said tread boards at both sides thereof;

upper outer and inner follower rails along said path on which said outer and inner follower rollers are rollably supported in said upper load run, the upper outer follower rail being mounted on the outer brackets in laterally spaced relation to said upper outer drive rail and the upper inner follower rail being mounted on the inner brackets in laterally spaced relation to said upper inner drive rail;

a lower inner intermittent follower rail secured to said main frame along the lower return run on which said inner follower roller moves;

outer and inner tread board chains drivingly connecting said tread board axles near their outer and inner end portions, respectively;

upper and lower presser rails fixedly secured to said main frame and extending along and spaced above at least one of said inner and outer upper and lower drive rails and engaging the coresponding drive rollers and limiting the movement of the drive rollers away from the coreredsponding drive rails;

a side roller mounted on only one end of each of said tread board axles with the rotational axis thereof extending orthogonally with respect to the tread board axles, the upper drive rail and lower presser rail at the ends of the tread board axles corresponding to the position of said side rollers, said upper drive rail and lower presser rail having lateral faces facing away from the center of said arcuate conveyor path, said side rollers engaging said lateral faces of the corresponding upper drive rail and lower presser rail along said upper load and lower return runs, respectively, in a direction for supporting the load applied to said tread board axles in the direction toward the center of said arcuate conveyor path and a connecting bracket disposed between the pair of said upper outer drive rail and said upper outer follower rail substantially midway between adjacent outer brackets, said connecting bracket rigidly connecting said rail pair together and bracing the drive rail of the pair agianst the lateral thrust force of said side rollers.

6. A curved moving staircase structure with a curved conveyor path having a substantially arcuate configuration in plan view, said structure comprising:

a main frame having an outer frame member disposed along the outer periphery of said arcuate conveyor path, an inner frame member disposed along the inner periphery of said arcuate conveyor path a plurality of radial crossbeams which are disposed at intervals along said conveyor path so as to diverge radially from the center of said arcuate conveyor path and which rigidly connect said outer and inner frame members, an outer bracket rigidly connected to each of said crossbeams, an inner bracket rigidly connected to each of said crossbeams;

a plurality of tread boards articulated in an endless loop and shiftably supported on said main frame for circulating along said arcuate conveyor path and having an upper load run, a lower return run, and horizontal upper and lower deflection portions connecting said upper and lower runs together at the upper and lower ends of said path, respectively;

a tread board axle for each tread board and on which the corresponding tread board is swingably mounted, each axle extending transversely to the direction of movement of said tread boards along said path;

outer and inner drive rollers rotatably mounted on each of the tread board axles near the outer and inner end portions, respectively;

upper and lower outer and inner drive rails along said path on which said outer and inner drive rollers are rollably supported in said upper load and lower return runs, the upper outer drive rail being mounted on the outer brackets and said upper inner drive rail being mounted on the inner brackets;

outer and inner follower rollers rotatably mounted on each of said tread boards at both sides thereof;

upper outer and inner follower rails along said path on which said outer and inner follower rollers are rollably supported in said upper load run, the upper outer follower rail being mounted on the outer brackets in laterally spaced relation to said upper outer drive rail and the upper inner follower rail being mounted on the inner brackets in laterally spaced relation to said upper inner drive rail;

a lower outer intermittent follower rail secured to said main frame along the lower return run on which said outer follower roller moves and a lower inner intermittent follower rail secured to said main frame along the lower return run on which said inner follower roller moves;

outer and inner tread board chains drivingly connecting said tread board axles near their outer and inner end portions, respectively;

upper and lower presser rails fixedly secured to said main frame and extending along and spaced above at least one of said inner and outer upper and lower drive rails and engaging the corresponding drive rollers and limiting the movement of the drive rollers away from the corresponding drive rails;

a side roller mounted on only one end of each of said tread board axles with the rotational axis thereof extending orthogonally with respect to the tread board axles, the upper drive rail and lower presser rail at the ends of the tread board axles corresponding to the position of said side rollers, said upper drive rail and lower presser rail having lateral faces facing away from the center of said arcuate conveyor path, said side rollers engaging said lateral faces of the corresponding upper drive rail and lower presser rail along said upper load and lower return runs, respectively, in a direction for supporting the load applied to said tread board axles in the direction toward the center of said arcuate conveyor path and a connecting bracket disposed between the pair of said upper outer drive rail and said upper outer follower rail substantially midway between adjacent outer brackets, said connecting bracket rigidly connecting said rail pair together and bracing the drive rail of the pair against the lateral thrust force of said side rollers.

7. A curved moving staircase structure with a curved conveyor path having a substantially arcuate configuration in plan view, said structure comprising:

a main frame having an outer frame member disposed along the outer periphery of said arcuate conveyor path, an inner frame member disposed along the inner periphery of said arcuate conveyor path, a plurality of radial crossbeams which are disposed at intervals along said conveyor path so as to diverge radially from the center of said arcuate conveyor path and which rigidly connect said outer and inner frame members, an outer bracket rigidly connected to each of said crossbeams, an inner bracket rigidly connected to each of said crossbeams;

a plurality of tread boards articulated in an endless loop and shiftably supported on said main frame for circulating along said arcuate conveyor path and having an upper load run, a lower return run, and horizontal upper and lower deflection portions connecting said upper and lower runs together at the upper and lower ends of said path, respectively;

a tread board axle for each tread board and on which the corresponding tread board is swingably mounted, each axle extending transversely to the direction of movement of said tread boards along said path;

outer and inner drive rollers rotatably mounted on each of the tread board axles near the outer and inner end portions, respectively;

upper and lower outer and inner drive rails along said path on which said outer and inner drive rollers are rollably supported in said upper load and lower return runs, the upper outer drive rail being mounted on the outer brackets and said upper inner drive rail being mounted on the inner brackets;

outer and inner tread board chains drivingly connecting said tread board axles near their outer and inner end portions, respectively;

upper and lower presser rails fixedly secured to said main frame and extending along and spaced above at least one of said inner and outer upper and lower drive rails and engaging the corresponding drive rollers and limiting the movement of the drive rollers away from the corresponding drive rails;

said tread board chain also each extending in an endless loop having upper and lower reversal points at the ends thereof;

a tension means for said endless outer and inner tread board chains, and which comprises a frame shiftable horizontally relative to said main frame, a wheel axle rotatably supported on said frame transversely to the shifting direction of said frame, outer and inner sprocket wheels secured to said wheel axle near the inner and outer ends thereof, respectively, with said outer and inner tread board chains reeved thereon, respectively, bracket means fixedly secured to said frame, upper and lower outer rail means secured to said main frame to guide said outer drive rollers to said reversal point and having horizontal parts connected to the lower ends of said upper and lower outer drive rails, upper and lower inner rail means secured to said main frame to guide said inner drive rollers to said reversal point and having horizontal parts connected to the lower ends of said upper and lower inner drive rails, and inclined rail means rigidly connected to said bracket means and having upper and lower outer and inner horizontal rail parts slidably engaged with the horizontal parts of said upper and lower rail means having said inclined rail parts smoothly connected to said horizontal rail parts at their one end and having the other end sloped toward the periphery of said sprocket wheels, whereby when said tension means is shifted horizontally, said inclined rail means is always engaged with said horizontal parts of said upper and lower rail means to form continuous rail surfaces to support said drive rollers.

* * * * *